US007883286B2

(12) United States Patent
Thiebaut

(10) Patent No.: US 7,883,286 B2
(45) Date of Patent: Feb. 8, 2011

(54) BEAUTY CARE PRODUCT APPLICATION DEVICE

(75) Inventor: Laure Thiebaut, Clichy (FR)

(73) Assignee: L'Oreal, Paris (FR)

( * ) Notice: Subject to any disclaimer, the term of this patent is extended or adjusted under 35 U.S.C. 154(b) by 1078 days.

(21) Appl. No.: 11/558,299

(22) Filed: Nov. 9, 2006

(65) Prior Publication Data

US 2007/0104531 A1 May 10, 2007

Related U.S. Application Data

(60) Provisional application No. 60/738,564, filed on Nov. 22, 2005.

(30) Foreign Application Priority Data

Nov. 9, 2005 (FR) ..... 05 53387

(51) Int. Cl.
*B43K 21/08* (2006.01)

(52) U.S. Cl. ..... 401/78; 401/75; 401/10; 132/107; 132/219; 132/221

(58) Field of Classification Search ..... 401/75–78, 401/88, 261, 263, 277, 10; 132/219, 107–109, 132/148, 221
See application file for complete search history.

(56) References Cited

U.S. PATENT DOCUMENTS 1,429,635 A * 9/1922 Ross ..... 132/107
2,007,245 A 7/1935 Gimonet
2,477,245 A 7/1949 Giddings et al.
2,529,765 A 11/1950 Exner
2,887,117 A 5/1959 Rosholt
5,333,627 A 8/1994 Mehringer et al.
5,547,303 A 8/1996 Pyrozyk
5,857,796 A 1/1999 Waldmann (Continued)

FOREIGN PATENT DOCUMENTS

FR 2 833 163 6/2003

(Continued)

OTHER PUBLICATIONS

U.S. Appl. No. 11/874,774, filed Oct. 18, 2007, Thiebaut, et al.

*Primary Examiner*—David J Walczak
(74) *Attorney, Agent, or Firm*—Oblon, Spivak, McClelland, Maier & Neustadt, L.L.P.

(57) ABSTRACT

A device for packaging and method for applying a product configured to be applied on fibers. One example of the device includes a base incorporating a recess to accommodate a cup. This example of the device also includes a cup forming a seat for receiving a stick of product and a driving means for moving the cup relative to the base between a stowed position of the cup in the recess and a usage position in which an applicator portion of the stick emerges at least partially from an opening of the recess. The device includes a plurality of separator/comb elements extending around at least a portion of the opening of the recess, the separator/comb elements being configured so as to engage with the fibers to separate/comb them simultaneously to, or after the application of, the product onto the fibers by the applicator portion. A method is of using the device is also provided.

48 Claims, 3 Drawing Sheets

U.S. PATENT DOCUMENTS

| | | | | |
|---|---|---|---|---|
| 5,899,621 | A * | 5/1999 | Wang | 401/78 |
| 6,315,478 | B1 | 11/2001 | Atkins | |
| 6,675,812 | B1 | 1/2004 | Wiley | |
| 6,766,806 | B2 * | 7/2004 | Thiebaut | 132/112 |
| 6,821,041 | B1 * | 11/2004 | Hallam et al. | 401/18 |
| 7,168,878 | B2 | 1/2007 | Tani | |
| 2002/0015611 | A1 | 2/2002 | Blondeel et al. | |
| 2003/0031501 | A1 | 2/2003 | Eadie | |
| 2003/0226573 | A1 | 12/2003 | Chan | |
| 2007/0020038 | A1 | 1/2007 | Tani | |

FOREIGN PATENT DOCUMENTS

| | | |
|---|---|---|
| FR | 2 859 884 | 3/2005 |
| FR | 2 890 544 | 3/2007 |
| WO | WO 01/21499 | 3/2001 |

* cited by examiner

BEAUTY CARE PRODUCT APPLICATION DEVICE

CROSS-REFERENCE TO RELATED APPLICATIONS:

This document claims priority to French Application Number 05 53387, filed Nov. 9, 2005, and U.S. Provisional Application No. 60/738,564, filed Nov. 22, 2005, the entire contents of which are hereby incorporated by reference.

FIELD OF THE INVENTION

The present invention relates to a device for packaging and applying a product. The invention is particularly suitable for packaging and applying a cosmetic make-up and/or beauty care product intended to be applied on keratinous fibers.

BACKGROUND OF THE INVENTION

Discussion of Background

The expression "keratinous fibers" refers to fibers such as the hair or the eyelashes, including artificial hair or false eyelashes. The expression "cosmetic product" means a product as defined in EC Council Directive 93/35/CEE dated 14$^{th}$ June 1993.

Conventional applicators for the application of a solid-form product onto the hair are described in documents U.S. Pat. Nos. 2,477,245 and 2,887,117.

The term mascara is understood to mean a composition designed to be applied to the eyelashes. It can be a composition for making up the eyelashes, a composition for cosmetic treatment of the eyelashes, a base make-up for the eyelashes, or a so-called "top-coat" composition to be applied over a first layer that has already been applied to the eyelashes.

These devices are presented principally in two forms depending on the texture of the mascara. In the case where the mascara is solid, it is then presented in a large diameter, shallow cup to facilitate the take-up of product from the surface via a wide opening of the cup. On the other hand, when the mascara is liquid, it is then held in an elongated container having a small diameter neck. A closure element designed to close off the small diameter neck carries a product applicator designed to be inserted into the container between uses so that it is placed in contact with the product.

In particular, solid mascaras are described in documents U.S. Pat. No. 2,007,245 and France Patent No. 2 833 163, Conventional solid mascaras sometimes must be dispersed with water prior to their application on the eyelashes. The purpose of adding water is to at least partially dissolve the surface of the block of mascara so that the product acquires, at least at its surface, a paste-like consistency capable of being taken up and then transferred to the eyelashes. As discussed in U.S. Pat. No. 2,007,245, because of the solubilisation of the product, the bristles implanted in the mascara are liable to become detached, and there is then a risk that these bristles will soil the surface onto which they fall. Furthermore, the more the user tries to separate the eyelashes, the thicker the coating becomes, thereby possibly degrading the effect of make-up.

These solid mascaras are in fact generally packaged in the same case together with a brush, the latter usually having to be pre-impregnated with water before being placed in contact with the block of mascara.

One problem posed by these solid mascaras lies in the complexity of their use, the necessity for a source of water, and in the rapid deterioration in the cleanliness of the packaging thereof. The need for a source of water to moisten the mascara prevents free use of the mascara. Moreover, the packaging of such a block of mascara separately from the associated brush takes up a considerable amount of space.

Also, France Patent No. 2 529 765 describes devices configured to contain liquid mascaras. When the product is already in liquid form, it is not necessary to add water, and it can be taken up directly by means of the applicator, a brush for example, and immediately transferred onto the eyelashes. Although effective, these devices have a drawback in that it can be difficult to gain access to the product, and therefore, difficult to empty the container in which the product is held. Moreover, given the number of components used in the manufacture of such devices, the formulation of a product that is compatible with each of these components is a complex undertaking.

There is a need for a means of applying product to the eyelashes with a package and an applicator device that is compact, easy to use, and inexpensive.

SUMMARY OF THE INVENTION

To this end, an example of the present invention concerns, in one of its aspects, a device for packaging and applying a product intended to be applied on keratinous fibers, in particular the eyelashes. The device includes a base incorporating a recess configured to accommodate a cup. The devices further includes a cup forming a seat configured to receive a stick of the product and a driving means configured to move the cup relative to the base between a stowed position of the cup in the recess and a usage position in which an applicator portion of the product stick emerges at least partially from an opening of the recess. The device further includes a plurality of separator/comb elements extending around at least a portion of the opening of the recess, the separator/comb elements being configured so as to engage with the keratinous fibers to separate/comb them simultaneously with application of the product. The separator/comb elements can also be used after the application of, the product to the fibers.

The term "stick" is understood to mean a product which retains its predetermined shape, in the absence of applied force, at ambient temperature and at atmospheric pressure. A product processed in stick form is self-supporting, preferably for at least 60 seconds. Generally, such sticks are obtained by hot molding of the product or by extrusion.

The driving means can be configured to move the cup in linear fashion relative to the base. For example, the driving means is typically formed by two elements of the base designed to be driven in rotation relative to each other so as to move the cup in linear fashion relative to the base. In one example, the device is similar to a packaging device for lipstick.

Advantageously, the separator/comb elements can extend parallel to an axis of displacement of the cup relative to the base.

For example, free ends of the separator/comb elements are defined in a first surface transverse with respect to an axis of displacement of the cup relative to the base. In particular, this first surface can be flat. Advantageously it can be oblique. In one non-limiting embodiment, the surface is perpendicular to the axis of displacement.

The periphery of the opening can be defined in a second transverse surface with respect to an axis of displacement of the cup relative to the base. In particular, this second surface can be flat. Advantageously it is oblique to the axis of displacement. In one non-limiting embodiment, the second surface is perpendicular to the axis of displacement.

The separator/comb elements can be obtained by molding with the base in a thermoplastic material. In particular, they can be obtained by bi-injection with the base. As a variant, they can also be fitted to the base. For example, they can be held by clamping, clipping, gluing and/or welding in holes in a wall delineating the opening.

Preferably, at least one free end of a separator/comb element is tapered, in particular in the shape of teeth or bristles to enable effective combing and/or separation of the keratinous fibers.

Advantageously, the separator/comb elements can be arranged along a portion of, or around the entire periphery of the opening. In one non-limiting embodiment, the separator/comb elements surround this opening so that when the cup is in the usage position, the product stick is completely surrounded by these separator/comb elements. The device according to the invention can typically then be used in all positions relative to a fringe of keratinous fibers.

The separator/comb elements can be identical to each other. They can also be evenly spaced around the periphery of the opening. Preferably, the device includes a closure element designed to engage with the base so as to enclose the product stick in the recess, the cup preferably being in the first "stowed" position. With the closure element in the assembled position on the base, the recess containing the product stick typically defines a sealed space.

The base can further include a row of additional separator/comb elements projecting beyond a portion of its outer surface, distinct from the periphery of the opening. Thus, the user can comb her eyelashes with this row, which can impart a separating and a combing action different from those provided by the separator/comb elements at the periphery of the opening.

In one example of the invention, the product stick can be a solid composition, in particular, the "dry-dispersible" type. The expression "dry-dispersible" refers to a composition designed, at ambient temperature to coat a substrate, in particular keratinous fibers, and more particularly the eyelashes, when they are respectively placed in direct contact with each other. The dry-dispersible composition typically does not require advance preparation. For example, the dry-dispersible composition can typically be applied in this instance without having to first place the composition in contact with an aqueous phase. Therefore, the dry-dispersible composition has an advantage over solid mascaras that are water-dispersible and have to be partially dissolved in advance in order to form a coating on keratinous fibers. The dry-dispersible composition according to the invention can be taken up, transferred, and spread.

For example, the product stick can be a solid composition having a hardness between 500 and 18,200 Pa, in particular between 900 and 10,000 Pa, and more particularly between 1,800 and 8,200 Pa. Such a hardness makes it possible to obtain a composition that has sufficient stiffness to be presented in the form of a stick while having a sufficiently "soft" texture to permit easy application on the eyelashes. In particular, the specified hardness facilitates depositing material by direct contact with the eyelashes without exerting pressure on the fringe of the eyelashes.

A preferred method used to determine the hardness of a cosmetic formulation according to the invention is the so-called "butter cutting wire" method. To this end, a stick of the composition of which the hardness is to be determined is prepared. The stick is obtained by molding a composition in an aluminium mold held at −28° C. for 45 minutes, then removed from the mold and formed into a packaging article, in particular a pen, and then kept at a temperature of 20° C. for 24 hours before the test. A stiff tungsten wire of diameter 250 μm is advanced towards the stick at a speed of 100 mm/min so that the stick is cut transversely by means of the wire. The measured hardness corresponds to the maximum shear force exerted by the wire on the stick at 20° C., this force being measured using a dynamometer such as model DFGS2 marketed by INDELCO-CHATILLON. The test is typically repeated 6 times. The average "Y" of the 6 readings taken using the above-mentioned dynamometer and is given in grams. This average is converted to Pascals using the following equation to obtain the hardness value of the stick: $(Y\times10^{-3}\times9.8)$/transverse cross-sectional surface area of the stick ($m^2$)

In the case of a cylindrical stick of circular cross-section, the transverse cross-sectional surface area is equal to $\pi\times R2$, R being the radius of the stick expressed in metres.

Preferably, the hardness of the compositions according to the present invention is such that the compositions are self-supporting and also can disintegrate easily to form a deposit on the surface of keratinous fibers when they are brought into contact therewith.

For example, the product stick can be rod shaped, having a longitudinal axis. This stick can include a tubular and cylindrical.

For example, a free end of the product stick axially opposite an end of this stick retained in the seating of the cup has a convex application surface.

In another of its aspects, the invention also includes a method for application of a beauty care product to keratinous fibers, in particular the eyelashes, involving application of the beauty care product in the form of a stick onto the fibers by means of an assembly according to the invention.

As should be apparent, the invention can provide a number of advantageous features and benefits. It is to be understood that, in practicing the invention, an embodiment can be constructed to include one or more features or benefits of embodiments disclosed herein with or without others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

DETAILED DESCRIPTION OF THE PREFERRED EMBODIMENTS

Figure 1:
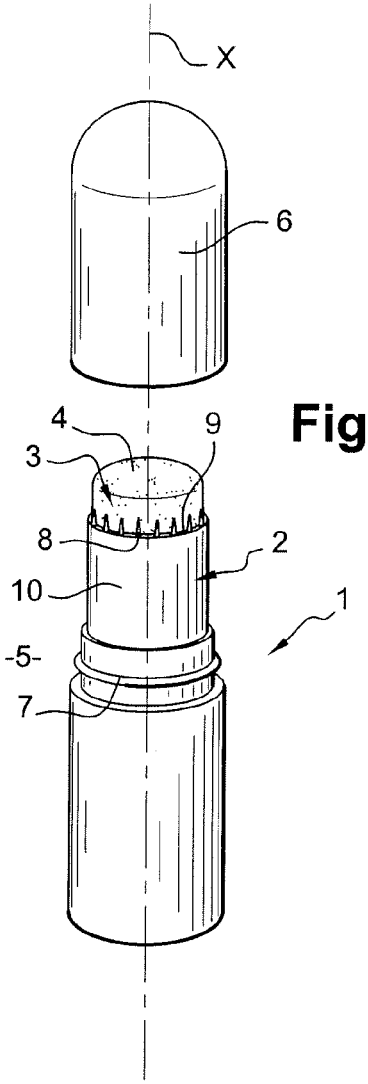
FIG. 1 is a profile view of an assembly according to an example of the invention.

Referring now to the drawings wherein like reference numerals designate identical or corresponding parts throughout the several views.

FIG. 1 illustrates a device 1 according to one example of the invention. This device 1 includes a base 2 delineating a recess emerging via an opening 3. A cylindrical product stick 4 emerges from this opening 3. The device 1 and the product stick 4 form an assembly 5 according to the example of the invention shown in FIG. 1.

In FIG. 1, the device 1 includes a closure element 6 detached from the base 2. In particular, in FIG. 1, the closure element 6 is designed to be detachably mounted around a part of the base 2, the latter presenting means of fixing in this case taking the form of a bead 7 configured to engage with a counterpart projection provided on the inner surface of the closure element 6.

The base 2 includes a plurality of separator/comb elements 8 disposed on the periphery of the opening 3. In particular, they stand off an edge 9 of a sleeve 10 of the base 2 at least partially laterally delineating the recess, the edge 9 delineating the periphery of the opening 3. In a variant not shown, these separator/comb elements 8 can be disposed on the edge of a ring slidably mounted around the sleeve 10.

The product stick 4 is disposed in a cup, not visible in FIG. 1, so as to be capable of being displaced relative to the base 2. The applicator portion of the product stick 4 corresponds to the outer surface of this stick projecting from the cup 12. In particular, the applicator portion of the stick 4 is configured to be brought into contact with keratinous fibers so that they can be coated by transfer of product. In particular, the user moves the product stick 4 longitudinally from the base of the eyelashes towards the free ends of the eyelashes. To apply the product, the user moves the cup 12 relative to the base 2 as necessary so as to render accessible at least a part of the applicator portion of the stick 4.

In FIG. 1, the product stick 4 is depicted as cylindrical, and the product stick 4 is preferably disposed in the cup 12 so that movement takes place along an axis X corresponding to a generatrix of the cylinder formed thereby and also corresponding to an axis of movement of the cup 12 in the base 2. The product stick 4 is solid, but typically capable of being deformed so as to be retained by friction fit in the cup 12. To improve the retention of the stick 4 in the cup 12, the cup 12 typically includes fins extending radially inward and intended to laterally restrain the stick.

The base 2 defines a recess emerging via the opening 3 wherein the product stick can be at least partially disposed. Thus, the product stick 4 can be moved from a first, so-called "stowed" position, where it is at least partially contained in the recess, to a second, so-called "usage" position, where one end of stick 4 emerges through the opening 3.

Before the first use, when the product stick 4 is whole, the stowed position and the usage position may coincide. The action of moving the cup becomes needed as the product stick diminishes in size due to progressive dispersal of the product stick 4 during use.

Figure 2:
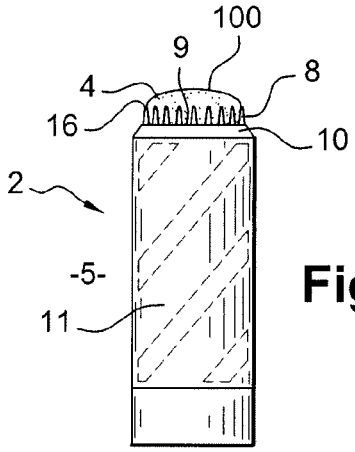
FIG. 2 is a profile view of an assembly according to a second example of the invention.
Figure 3:
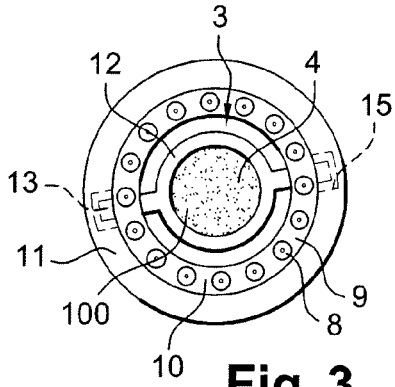
FIG. 3 is a top view of the assembly shown in FIG. 2.
Figure 4:
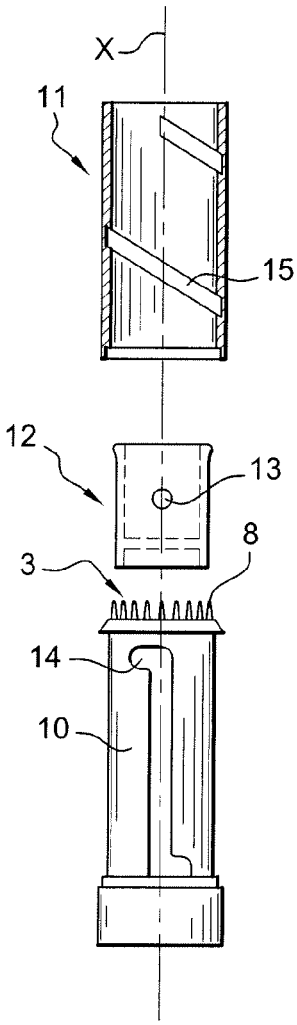
FIG. 4 is an exploded view of the assembly shown in FIG. 2 without its product stick.

In FIGS. 2 to 4, a device 1 according to another exemplary embodiment of the invention is shown. The sleeve 10 is in this case surrounded by an enclosure 11 of the base 2. In FIGS. 3 and 4, the cup 12 wherein the stick 4 is disposed is visible. The cup 12 includes two diametrically opposed lugs 13 arranged to slide in two diametrically opposed guide slots 14 of the sleeve 10. The ends of the lugs 13 engage in helical grooves 15 in the enclosure 11 so that rotational movement of the sleeve 10 relative to the enclosure 11 is accompanied by an axial movement of the cup 12. The means of driving the cup 12 relative to the base 2 is formed by the assembly of the cup 12, the sleeve 10, and the enclosure 11.

In the example shown in FIG. 2, the separator/comb elements 8 are identical to each other and evenly spaced on the periphery of the opening 3, which in this instance is circular. In effect, the edge 9 of the sleeve 10 defines an annular zone from which the separator/comb elements 8 project. The opening 3 is defined by the edge 9 of the sleeve 10. In this instance, it is defined in a plane perpendicular to the longitudinal axis X of the stick 4, which typically corresponds substantially to the axis of movement of the cup 12 relative to the base 2. The separator/comb elements 8 are identical to each other in the example shown in FIGS. 2 to 4. The free ends 16, in this instance, form tapered points, are also defined in a plane perpendicular to the axis X. The separator/comb elements 8 are, for example, cones with a circular or polyhedral base, optionally truncated.

Figure 5:
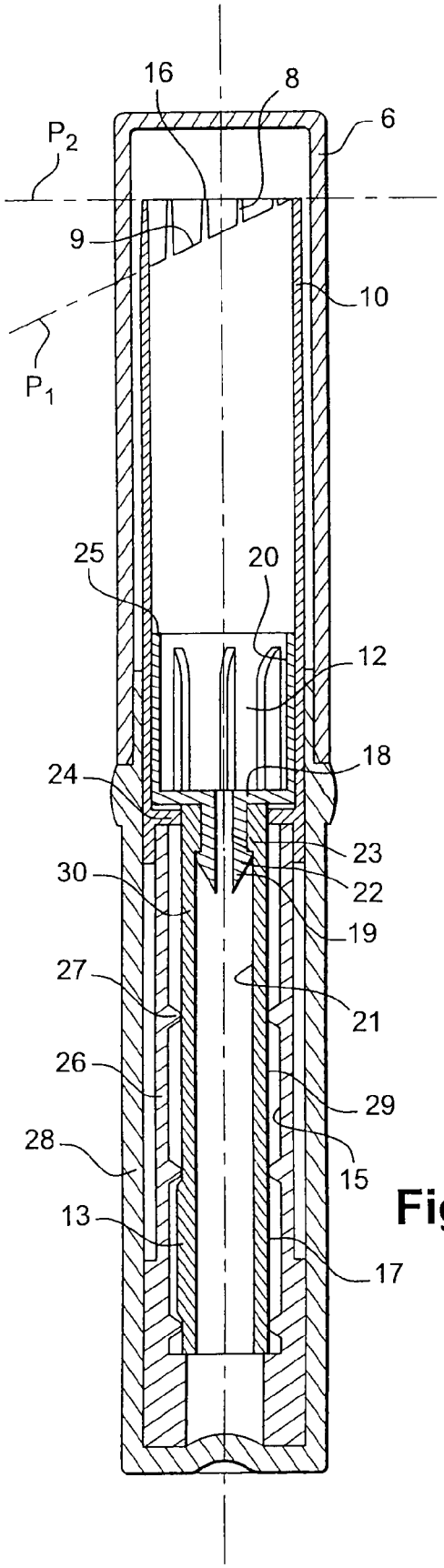
FIG. 5 is a lengthwise sectional view of an assembly according to a third example of the invention shown without a product stick.

FIG. 5 shows a device 1 according to another non-limiting example of the invention. Here, the cup 12 is rendered rotationally integral with a first tube 17 extending opposite the seating intended to receive the product stick 4. In this example, the cup 12 includes a bottom wall 18 defining a transverse wall of the seating, fixing means 19 projecting from this bottom wall 18 on a side opposite an annular skirt 20 disposed on this bottom wall 18 to define the lateral periphery of the seating.

The fixing means 19 are configured to cooperate by snap attachment with the inner surface 21 of an end of the first tube 17. In addition, these fixing means 19 incorporate rings 22 configured to engage in a complementary projection 23 on the inner surface 21. Thus, the first tube 17 is immobilized in linear movement and in rotation relative to the cup 12.

The sleeve 10 defines the recess inside which the cup 12 is designed to be moved in a linear fashion. The cup 12 is mobile between a stowed position wherein the bottom wall 18 abuts against an annular periphery 24 projecting radially towards the inside of the sleeve 10, and a higher so-called usage position wherein at least one free end 100 (shown in FIG. 2) of the stick 4 carried in the cup 12 or an edge 25 of the annular skirt 20 projects beyond the opening 3 defined by the edge 9 of the sleeve 10. In this instance, the opening 3 is defined in an oblique plane relative to the longitudinal axis X of the stick 4, this axis X being superimposed on the axis of linear travel of the cup 12 in the sleeve 10.

The annular periphery 24 defines an aperture through which the fixing means 19 and the first tube 17 partially extend. In the example shown in FIG. 5, the first tube 17 has on its outer circumference 29 two diametrically opposed lugs 13, and the sleeve 10 is integral in linear movement with a second tube 26 having a screw thread 27 on its inner surface configured to engage with the two lugs 13. The pitch of the screw thread defines the helical groove 15 with which the lugs 13 cooperate.

The assembly formed by the sleeve 10, the cup 12, the first tube 17, and the second tube 26, is disposed in a receptacle 28 of the base 2, so that the second tube 26 is integral in rotation and in linear movement relative to this receptacle 28, and the rotational movement of the sleeve 10 relative to this receptacle 28 produces a linear movement of the cup 12 in its recess. In effect, the annular periphery 24 includes notches extending radially towards the inside of the formed aperture so as to engage with lengthwise grooves 30 defined on the outer circumference 29 of the first tube 17.

In the example shown in FIG. 5, the separator/comb elements 8 are disposed on the edge 9 parallel to the axis X, and they are of different height measured parallel to the axis X so that the free ends 16 of the separator/comb elements 8 are defined in a plane P2 which intersects with the plane P1 of the opening 3 and which is furthermore perpendicular to the axis X. In this example, the free ends 16 form flat-topped crests. The separator/comb elements 8 are evenly spaced on the periphery of this opening 3 in the example shown in FIG. 5, but other arrangements are possible.

Figure 6:
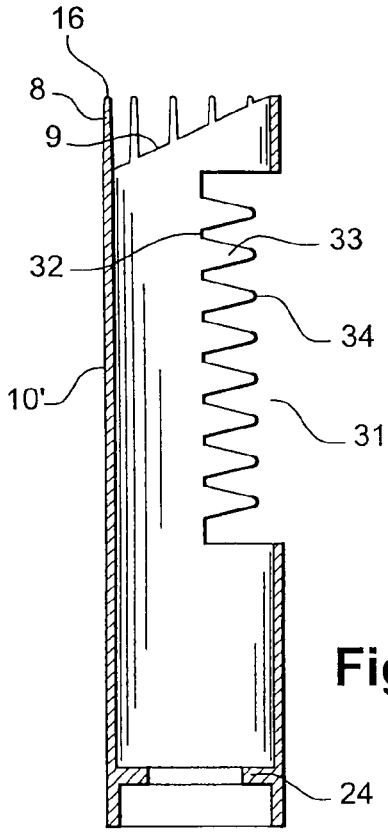
FIG. 6 is a lengthwise sectional view of an alternative sleeve capable of being mounted on a device according to FIG. 5.

In an alternative embodiment of the sleeve 10' depicted in FIG. 6 and configured to be mounted in a device such as that in FIG. 5, the sleeve 10' includes a lengthwise window 31 through which the product stick 4 can also be accessible laterally in relation to the position of the cup 12 in the recess. In particular, the longitudinal edges 32 of this window can have second separator/comb elements 33. When, for example, the product stick 4 is of circular cross-section, the separator/comb elements 33 may be curved so as to conform in part to the lateral cylindrical outline of the stick 4. The separator/comb elements 33 are arranged such that a plane passing through the free ends 34 of these separator/comb elements intersects with the stick 4. In one example, the plane passing through the free ends intersects the stick 4 longitudinally.

Thus, when using such a device 1 fitted with a sleeve 10', the user can apply make-up to the eyelashes by bringing them into contact with the longitudinal end 100 of the stick 4, or into contact with a lateral portion of the stick accessible via the window 31.

Figure 7:
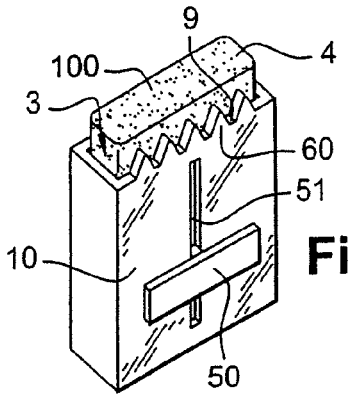
FIG. 7 is a profile view of an assembly according to the invention in a fourth example of the invention.
Figure 8:
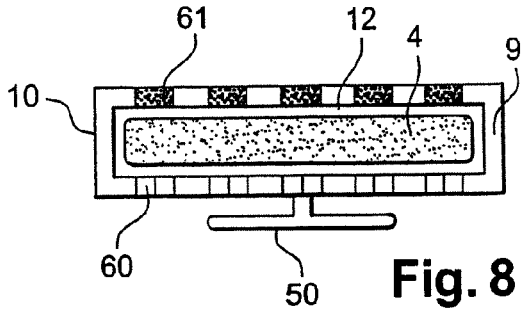
FIG. 8 is a top view of the assembly according to FIG. 7.
Figure 9:
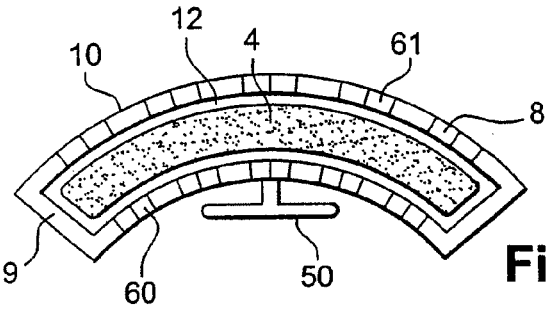
FIG. 9 is a top view of an alternative example of the assembly according to FIG. 7.

In a further examples of the invention, several variants of which are presented in FIGS. 7 to 9, the cup 12 is integral with a slider 50 projecting from the outer surface of the sleeve 10 inside which it can be moved in a linear fashion. To this end, the sleeve 10 includes a slot 51 through which the slider 50 projects so that it can be moved manually and thereby move the product stick 4 in the direction of the opening 3. The product stick 4 is of rectangular transverse cross-section in the example shown in FIGS. 7 and 8. FIG. 9 shows an alternate example in which the product stick has a transverse cross-section representing an arc-shaped section of a ring so as to adapt to the particular geometry of a fringe of eyelashes. Other shapes are also possible.

In FIGS. 7 to 9, the opening 3 is of a shape similar to that of the product stick 4. The opening 3 is typically flat and defined in a plane perpendicular to the axis X of linear travel of the cup 12 which corresponds to the axis of the generatrix of the cylinder formed by the product stick 4. In the variants shown, the edge 9 of the sleeve 10 from which extend the separator/comb elements 8 has separator/comb elements of different shapes. In particular, as shown in FIGS. 7 and 8, the edge 9 includes a first row 60 of teeth of triangular lengthwise cross-section so that each tooth has a tapered point. It also includes a second row 61 of tufts of bristles implanted in the edge 9.

In the example shown in FIG. 9, the edge 9 also has first and second rows 60 and 61. In this example, the separator/comb elements differ in terms of their lengthwise cross-section. In effect, the separator/comb elements of the first row 60 are more tapering and more closely spaced than those of the second row 61.

Additionally, the separator/comb elements 8 may be provided at the periphery of the opening 3, irrespective of which embodiment of the invention is used, and the separator/comb elements 8 may differ between themselves in shape such that spaces provided between these separator/comb elements 8 are different from each other, i.e., the elements are unevenly spaced from each other.

Figure 10:
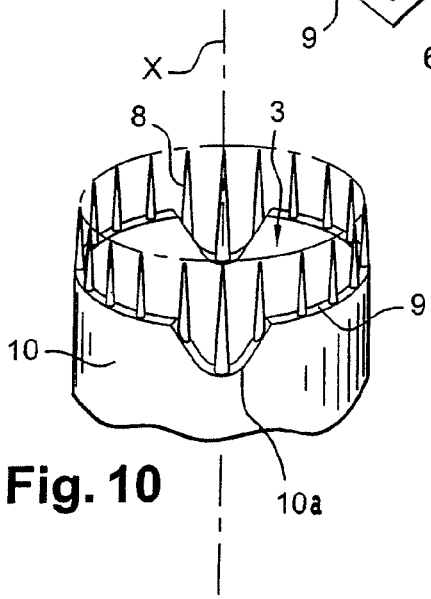
FIGS. 10 to 16 are profile views of alternative examples of separator/comb elements.

FIGS. 10 to 16 depict alternative embodiments of the opening 3 and the separator/comb elements 8. In FIG. 10, the surface in which the opening 3 is defined, that is the edge 9 of the sleeve 10, incorporates a concave shape or notch 10*a*, In this example, the separator/comb elements are disposed on the edge 9 such that they are parallel to the axis X. They are evenly spaced in the example shown in FIG. 10, but may be unevenly spaced in other examples. In the example shown in FIG. 10, they form fine teeth with a tapered cylindrical transverse cross-section arranged so that their free ends are all defined in a plane perpendicular to the axis X. A lengthwise cross-section of these separator/comb elements is triangular. However, other configurations are possible.

Figure 11:
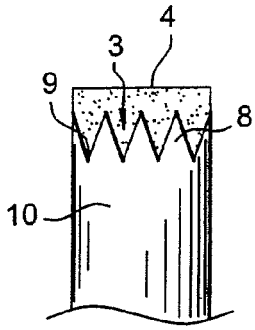
Figure 12:
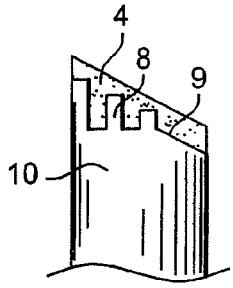
Figure 13:
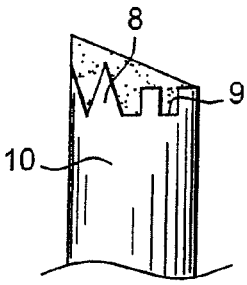
Figure 14:
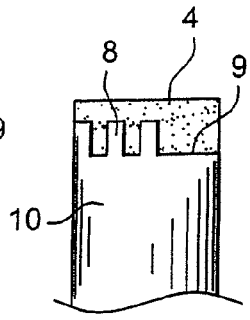
Figure 15:
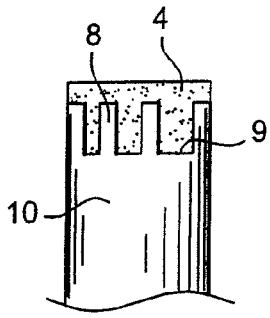

In one variation of the example shown in FIG. 10, the separator/comb elements 8 extend from the edge 9 delineating the opening 3 which extends in a plane perpendicular to the axis X, and the bases of these separator/comb elements are contiguous as shown in FIG. 11.

In the examples shown in FIGS. 12 to 16, the lengthwise and transverse cross-sections of the separator/comb elements 8, the shape of the free end of the stick 4, the surface in which the opening 3 is defined, the surface in which the free ends 16 of the separator/comb elements 8 are defined, and the spacings between these separator/comb elements, are of different configurations.

The lengthwise cross-sections of the separator/comb elements 8 can be rectangular, square, triangular, trapezoidal or any other geometric shape. Furthermore, the transverse cross-sections of the separator/comb elements 8 can be rectangular, square, triangular, trapezoidal, circular or any other geometric shape.

The separator/comb elements 8 can be obtained by molding with the sleeve 10 from the same thermoplastic material. In this way, the separator/comb elements 8 and the sleeve 10 are integrally formed together. Alternatively, the separator/comb elements 8 can be obtained by over-molding or bi-injection in a more flexible material than the sleeve 10. For example, the sleeve 10 is made of a polyolefin material while the separator/comb elements 8 are made of an elastomer material.

Figure 16:
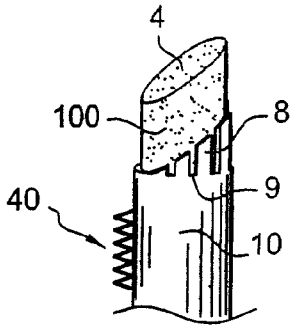

In particular, in the alternative embodiment depicted in FIG. 16, the sleeve 10 includes a row of separator/comb elements 40 disposed radially outward from the lateral surface of the sleeve 10. Combing means independent of any application of product are thus provided.

In the case where the product stick 4 includes volatile solvents, the closure element 6 preferably provides leaktight closure of the recess in which the stick 4 is disposed.

One advantage of the devices according to certain examples the invention lies in the fact that they offer a solution enabling the product stick 4 to be moved out of its recess only over a limited portion of its length, whereby only the portion needed to apply product to the eyelashes is extended from the recess and exposed to the ambient air. Deterioration of the product stick is thus reduced by retarding the volatilisation of any volatile solvents contained therein. The stick 4 is generally presented so that the free end is brought into contact from below with a user's eyelashes. The separator/comb elements 8 can be used to comb and separate the eyelashes with the product stick remaining in its usage position or having already been returned to the stowed position.

In one usage position, the end of the stick 4 is typically caused to project beyond the surface, or the plane as the case may be, defined by the free ends of the separator/comb elements 8.

Figure 17:
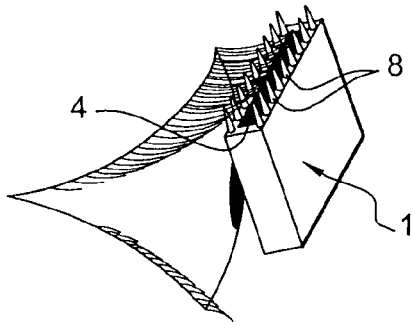
FIG. 17 is a profile view of an assembly according to FIG. 7 during use.

In the usage position shown in FIG. 17, the end of the stick 4 is maintained above the plane P1 of the opening and below the plane P2 of the free ends 16 of the separator/comb elements 8. As the make-up is being applied to the eyelashes, the device is brought into contact with the eyelashes several times and in particular with the fringe of the eyelashes on the upper eyelid. The separator/comb elements 8 are moved along the eyelashes from the base towards the free end thereof. During this relative movement, the eyelashes engaged between the separator/comb elements 8 are pressed against the end of the stick 4. The loading of product onto the eyelashes depends on the number of times that they have been placed in contact with the stick during these relative movements and the height of the stick between the planes P1 and P2.

A make-up loading action is also possible, wherein the product stick is extended beyond the free ends 16 so as to be placed in contact with the eyelashes without the latter being combed. A combing action can then be performed afterwards once the stick has been retracted below the plane P2 or the plane P1.

Throughout the description and claims, expressions such as "including one", "having one", "has one", or "comprises one" should be regarded as synonymous with "including at least one", unless otherwise specified.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letter Patent of the United States is:

1. An assembly comprising a device for packaging and applying a product, and a stick of the product configured to be applied on eyelashes, the device including:

a base incorporating a recess configured to accommodate a cup;

a cup forming a seat configured to receive the stick of the product;

a driving means configured to move the cup relative to the base between a stowed position of the cup in the recess and a usage position in which an applicator portion of the stick emerges at least partially from an opening of the recess;

a plurality of separator/comb elements extending along at least a portion of the opening of the recess, the separator/comb elements being configured so as to engage with the eyelashes to separate/comb them simultaneously to, or after the application of, the product onto the eyelashes by the applicator portion.

2. The assembly according to claim 1, wherein the driving means is configured to move the cup linearly relative to the base.

3. The assembly according to claim 1, wherein the driving means is formed by two elements of the base configured to be driven in rotation relative to each other so as to move the cup linearly relative to the base.

4. The assembly according to claim 1, wherein the separator/comb elements extend in a direction parallel to an axis of displacement of the cup relative to the base.

5. The assembly according to claim 1, wherein free ends of the separator/comb elements terminate along a same plane.

6. The assembly according to claim 5, wherein the plane is oblique relative to an axis of displacement along which the cup moves relative to the base.

7. The assembly according to claim 5, wherein the plane is perpendicular to an axis of displacement along which the cup moves relative to the base.

8. The assembly according to claim 1, wherein a periphery of the opening is defined in a plane non-parallel to an axis of displacement of the cup relative to the base.

9. The assembly according to claim 8, wherein the plane is oblique with respect to the axis of displacement of the cup relative to the base.

10. The assembly according to claim 8, wherein the plane is perpendicular to the axis of displacement.

11. The assembly according to claim 1, wherein the separator/comb elements are integrally molded with the base in a thermoplastic material.

12. The assembly according to claim 1, wherein the separator/comb elements are obtained by overmolding or bi-injection with the base with a material more flexible than the base.

13. The assembly according to claim 1, wherein the separator/comb elements are held by clamping, clipping, gluing and/or welding in holes in a wall delineating the opening.

14. The assembly according to claim 1, wherein at least one free end of the separator/comb elements is tapered.

15. The assembly according to claim 1, wherein at least one free end of the separator/comb elements is in the form of teeth or bristles.

16. The assembly according to claim 1, wherein the separator/comb elements are arranged along an entire periphery of the opening.

17. The assembly according to claim 1, wherein the separator/comb elements are identical to each other.

18. The assembly according to claim 1, wherein the separator/comb elements are evenly spaced from one another.

19. The assembly according to claim 1, wherein the separator/comb elements are unevenly spaced from one another.

20. The assembly according to claim 1, further comprising a closure element designed to engage with the base so as to enclose the product stick in the recess.

21. The assembly according to claim 1, wherein the base includes a row of second separator/comb elements projecting beyond a portion of its outer surface, distinct from the periphery of the opening.

22. The assembly according to claim 1, wherein the stick of product is a dry-dispersible solid composition.

23. The assembly according to claim 22, wherein the product is a solid composition having a hardness between 500 and 18,200 Pa.

24. The assembly according to claim 23, wherein the hardness is between 900 and 10,000 Pa.

25. The assembly according to claim 23, wherein the hardness is between 1,800 and 8,200 Pa.

26. The assembly according to claim 25, wherein a free end of the stick of product axially opposite an end retained in the seating of the cup has a convex application surface.

27. The assembly according to claim 22, wherein the stick of product has a longitudinal axis parallel to a direction of displacement of the cup.

28. A method of applying make-up and beauty care for eyelashes comprising:

(a) providing a device for packaging and applying a product configured to be applied on eyelashes including (i) a base incorporating a recess configured to accommodate a cup, (ii) a cup forming a seat configured to receive a stick of the product, (iii) a stick of product formed of dry-dispersible solid composition disposed in the cup, (iv) a driving means configured to move the cup relative to the base between a stowed position of the cup in the recess and a usage position in which an applicator portion of the stick emerges at least partially from an opening of the recess, (v) a plurality of separator/comb elements extending along at least a portion of the opening of the recess, the separator/comb elements being configured so as to engage with the eyelashes to separate/comb them simultaneously to, or after the application of, the product onto the eyelashes by the applicator portion; and (b) applying make-up and/or beauty care product onto the eyelashes.

29. The assembly according to claim 1, wherein the base and separator/comb elements comprise different materials from each other.

30. The assembly according to claim 1, wherein the base comprises a rectangular shaped sleeve, and the opening is rectangular shaped.

31. The assembly according to claim 30, wherein separator/comb elements on a first side of the opening are differently shaped from separator/comb elements on a second side of the opening.

32. The assembly according to claim 31, wherein the separator/comb elements on the first side of the opening are bristles, and the separator/comb elements on the second side of the opening have a triangular cross-section so as to include a tapered point.

33. The assembly according to claim 1, wherein the base comprises an arc-shaped sleeve, and the opening is arc-shaped.

34. The assembly according to claim 33, wherein separator/comb elements on a first side of the opening are differently shaped from separator/comb elements on a second side of the opening.

35. The assembly according to claim 1, wherein the base comprises a tube-shaped sleeve and a perimeter of the opening includes a notch extending in a direction parallel to an axis of displacement of the cup relative to the base.

36. The assembly according to claim 1, wherein the base comprises a slider configured to slide in a direction parallel to an axis of displacement of the cup relative to the base so as to move the cup along the axis of displacement.

37. The assembly according to claim 36, wherein the sleeve is a rectangular shaped-sleeve, and the opening is rectangular shaped.

38. The assembly according to claim 1, further comprising a row of radially extending separator/comb elements disposed on a sleeve of the base, the row extending in a direction of displacement of the cup.

39. The assembly according to claim 1, wherein the row of radially extending separator/comb elements is disposed on an outer surface of the sleeve.

40. An assembly comprising a device for packaging and applying a product, and a stick of the product configured to be applied on eyelashes, the device including:

an enclosure;

an internal sleeve disposed inside the enclosure and including an opening at one end and a slot extending in a longitudinal direction;

a recess inside the internal sleeve;

a cup, disposed inside the recess, including a seat configured to receive a stick of the product, wherein the cup is movable relative to the internal sleeve between a stowed position and a usage position in which an applicator portion of the stick emerges at least partially from an opening of the recess;

a plurality of separator/comb elements extending from at least a portion of the opening, the separator/comb elements being configured so as to engage with the eyelashes to separate/comb them.

41. The assembly according to claim 40, further including a drive mechanism to move said cup between said stowed position and said usage position.

42. The assembly according to claim 40, wherein the separator/comb elements extend in a direction parallel to an axis of displacement of the cup relative to the internal sleeve.

43. The assembly according to claim 40, wherein free ends of the separator/comb elements terminate along a same plane.

44. The assembly according to claim 40, wherein the separator/comb elements are arranged along an entire periphery of the opening.

45. The assembly according to claim 40, wherein the separator/comb elements are identical to each other.

46. The assembly according to claim 40, wherein the separator/comb elements are evenly spaced from one another.

47. The assembly according to claim 40, wherein the separator/comb elements are unevenly spaced from one another.

48. The assembly according to claim 1, wherein the portion of the opening of the recess includes first and second curved sides of the recess, the first side being curved in the same direction as the second side such that the first and second sides are concave in the same direction.

* * * * *